US011404836B2

(12) United States Patent
Peterson et al.

(10) Patent No.: US 11,404,836 B2
(45) **Date of Patent: *Aug. 2, 2022**

(54) PERPENDICULAR ELECTRICAL CONNECTOR FOR WIRING

(71) Applicant: Aptiv Technologies Limited, St. Michael (BB)

(72) Inventors: David R. Peterson, Aurora, OH (US); Joseph Sudik, Jr., Niles, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/670,113

(22) Filed: Oct. 31, 2019

(65) Prior Publication Data

US 2021/0135414 A1 May 6, 2021

(51) Int. Cl.

| | |
|---|---|
| ***H01R 25/00*** | (2006.01) |
| ***H01R 25/16*** | (2006.01) |
| ***H01R 13/24*** | (2006.01) |
| ***H01R 13/506*** | (2006.01) |
| ***H01R 13/52*** | (2006.01) |
| ***H01R 13/66*** | (2006.01) |
| ***H01R 33/09*** | (2006.01) |

(52) U.S. Cl.

CPC ..... *H01R 25/162* (2013.01); *H01R 13/24* (2013.01); *H01R 13/506* (2013.01); *H01R 13/5202* (2013.01); *H01R 13/6683* (2013.01); *H01R 33/09* (2013.01)

(58) Field of Classification Search

CPC .... H01R 25/162; H01R 25/161; H01R 25/16; H01R 25/13; H01R 25/14; H01R 25/142; H01R 25/145; H01R 25/147; H01R 13/24; H01R 13/22; H01R 13/02; H01R 13/506; H01R 13/502; H01R 13/5202; H01R 13/46; H01R 13/608; H01R 13/66; H01R 33/09; H01R 33/06; H01R 25/00

USPC ..... 439/119

See application file for complete search history.

(56) References Cited

U.S. PATENT DOCUMENTS 2,692,375 A * 10/1954 Carson ..... F21V 21/002 439/391
2,856,592 A * 10/1958 Carlson ..... H01R 25/142 439/119

(Continued)

FOREIGN PATENT DOCUMENTS

| | | |
|---|---|---|
| EP | 669627 B1 | 8/2002 |
| GB | 1327194 A | 8/1973 |
| WO | 9416480 | 7/1994 |

OTHER PUBLICATIONS

European Search Report dated Feb. 11, 2021. 10 pages.

*Primary Examiner* — Harshad C Patel
(74) *Attorney, Agent, or Firm* — Jason M. Benedict

(57) ABSTRACT

An electrical connector includes wiring with first and second wires. Each of the first and second wires have a conductor covered in insulation. The insulation includes webbing that interconnects the first and second wires to one another. The first and second wires have a stripped portion that exposes the conductors. A housing has first and second housing portions. The first housing portion receives the stripped portions. The second housing portion includes first and second spring features respectively configured to engage the stripped portions of the first and second wires when the first and second housing portions are secured to another in an assembled connector condition.

19 Claims, 7 Drawing Sheets

(56) References Cited

U.S. PATENT DOCUMENTS 4,173,035 A * 10/1979 Hoyt ..... F21V 21/08 362/249.04
4,196,956 A * 4/1980 Hoffman ..... H01R 13/501 439/404
4,777,573 A * 10/1988 Liao ..... F21V 21/002 313/51
5,051,877 A * 9/1991 Liao ..... F21V 21/002 362/249.16
5,109,324 A * 4/1992 Ahroni ..... F21V 21/002 362/249.01
5,228,774 A * 7/1993 Liao ..... F21V 21/002 362/391
5,306,165 A * 4/1994 Nadeau ..... H01R 25/14 439/115
5,325,267 A * 6/1994 Ewing ..... H01R 25/162 174/255
5,622,425 A * 4/1997 Lin ..... F21V 21/002 362/249.01
5,672,000 A * 9/1997 Lin ..... F21V 21/002 362/241
5,681,179 A * 10/1997 Lane ..... H01R 4/2406 439/393
5,829,865 A * 11/1998 Ahroni ..... H01R 12/675 362/657
6,079,848 A * 6/2000 Ahroni ..... H01R 4/242 362/249.01
6,129,443 A * 10/2000 Murata ..... H01R 33/02 362/225
6,163,958 A * 12/2000 Suzuki ..... H01R 43/01 29/33 M
6,328,593 B1 * 12/2001 Chang ..... F21V 21/002 439/419
6,558,184 B1 * 5/2003 Melocchi ..... H01R 4/2433 439/417
7,063,561 B2 * 6/2006 Pabst ..... H01R 12/61 439/495
7,070,443 B2 * 7/2006 Tashiro ..... F21V 21/002 439/419
7,144,256 B2 12/2006 Pabst et al.
7,210,957 B2 * 5/2007 Mrakovich ..... H01R 25/147 439/404
7,232,334 B2 6/2007 Shimizu et al.
7,341,476 B2 * 3/2008 Soeta ..... H01R 12/61 439/493
7,429,186 B2 * 9/2008 Mrakovich ..... H01R 13/7175 439/404
7,438,566 B2 * 10/2008 Chen ..... H01R 25/145 439/110
7,513,675 B2 * 4/2009 Mier-Langner ..... F21S 8/038 362/147
7,556,511 B1 * 7/2009 Hsu ..... H01R 13/652 439/119
8,963,378 B1 * 2/2015 Fornage ..... H01R 43/26 307/147
9,048,563 B2 6/2015 Miura et al.
9,178,297 B2 * 11/2015 Kodaira ..... H01R 12/774
9,360,196 B2 * 6/2016 Nicieja ..... F21V 21/35
9,912,100 B2 * 3/2018 Zantout ..... F21V 23/06
9,929,486 B2 * 3/2018 Englaro ..... H01R 12/75
11,038,288 B2 * 6/2021 Peterson ..... H01R 4/48
2011/0096545 A1 * 4/2011 Chang ..... F21V 21/002 362/249.02

* cited by examiner

PERPENDICULAR ELECTRICAL CONNECTOR FOR WIRING

FIELD OF INVENTION

The disclosure relates to electrical connectors for use with wiring.

SUMMARY

In one exemplary embodiment, an electrical connector includes wiring with first and second wires. Each of the first and second wires have a conductor covered in insulation. The insulation includes webbing that interconnects the first and second wires to one another. The first and second wires have a stripped portion that exposes the conductors. A housing has first and second housing portions. The first housing portion receives the stripped portions. The second housing portion includes first and second spring features respectively configured to engage the stripped portions of the first and second wires when the first and second housing portions are secured to another in an assembled connector condition.

In a further embodiment of any of the above, each spring feature has a curved portion that engages its corresponding stripped portion. Each curved portion extends to a longitudinally extending electrical connection portion that is supported within the second housing portion. Each electrical connection portion is arranged perpendicular to its corresponding stripped portion.

In a further embodiment of any of the above, the housing includes at least one snap feature that removably connects the first and second housing portions in the assembled connector condition.

In a further embodiment of any of the above, the electrical connection portions terminate in a male terminal or a female terminal.

In a further embodiment of any of the above, the electrical connector includes first and second seals that respectively support the first and second housing portions and are arranged on opposing sides of the wiring.

In a further embodiment of any of the above, the second housing portion has an end that supports the electrical connection portions. The electrical connection portions are exposed at the end and are configured for electrical connection to an external electrical component.

In a further embodiment of any of the above, the external electrical component is a sensor.

In a further embodiment of any of the above, the electrical connector includes a secondary lock that is provided between the second housing portion and the external electrical component. The secondary lock is configured to selectively removably secure the second housing portion and the external electrical component to one another.

In a further embodiment of any of the above, the second housing portion includes a socket. The external electrical component is a lighting device received in the socket.

In a further embodiment of any of the above, the lighting device includes male terminals. The electrical connection portions are female terminals that are configured to receive the male terminals.

In a further embodiment of any of the above, the wiring terminates at the second housing portion.

In a further embodiment of any of the above, the wiring includes a terminal end that is supported on the second housing portion.

In a further embodiment of any of the above, the terminal end is mounted to an outside of the second housing portion.

In a further embodiment of any of the above, the first housing portion is common to and secured to a multiple of the second housing portion. The wiring is a first wiring connected between the first housing portion and one of the multiple of second housing portions and includes a second wiring connected between the first housing portion and another of the multiple of second housing portions. The second wiring has third and fourth wires. Each of the third and fourth wires have second conductors covered in a second insulation. The second insulation includes a second webbing that interconnects the third and fourth wires to one another. The third and fourth wires have second stripped portions that expose the second conductors. The first housing portion receives the second stripped portions. The second housing portion includes third and fourth spring features that are respectively configured to engage the second stripped portions of the third and fourth wires when the first housing portion and the second of the multiple of second housing portions are secured to another in the assembled connector condition.

In a further embodiment of any of the above, the first housing portion includes a slot that is configured to receive the first wiring and the second wiring.

In a further embodiment of any of the above, a wiring harness includes the electrical connector. The electrical connector further includes a clip that is configured to secure the first wiring and the second wiring near the first housing portion.

In a further embodiment of any of the above, the second housing contains a sensor that is electrically connected to the first and second spring features.

In a further embodiment of any of the above, a wiring harness includes the electrical connector.

In a further embodiment of any of the above, the electrical connector includes a multiple of the electrical connectors.

BRIEF DESCRIPTION OF THE DRAWINGS

The disclosure can be further understood by reference to the following detailed description when considered in connection with the accompanying drawings wherein.

DETAILED DESCRIPTION

An example wiring harness 10 is shown with multiple electrical connectors provided by housings 12, 112, 212. Clips 11 of various configurations may be used at desired locations along the wiring harness 10 to secure the harness to a vehicle, for example.

Figure 2:
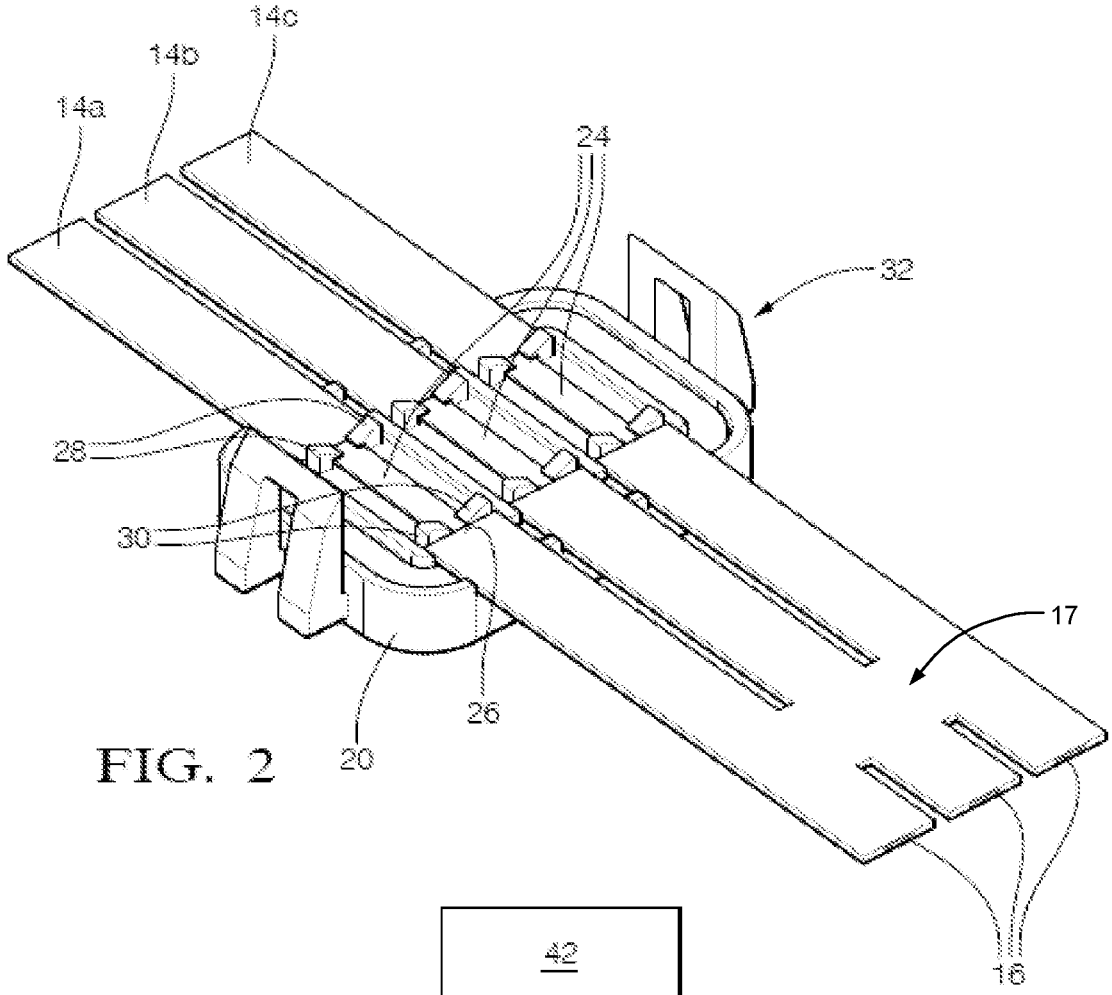
FIG. 2 illustrates a first housing portion of one of the electrical connectors shown in FIG. 1.

The connectors of this disclosure are particularly suitable for use with flat wires. Referring to FIG. 2 for example, the insulative housing 12 may be constructed from multiple plastic pieces, such as first and second housing portions 20, 22. The housing 12 includes at least one snap feature 32 (e.g., cooperating hook and protrusion) removably connecting the first and second housing portions 20, 22 in the assembled connector condition. The exemplary housing 12 may vary from the configuration depicted, particularly the second housing portion 22, which may be integrated with an electrical component 13 such as a lighting device, sensor, electrical connector, or other electrical device, as will be appreciated below in connection with the various disclosed housings 12, 112, 212, 212', 312.

Figure 1:
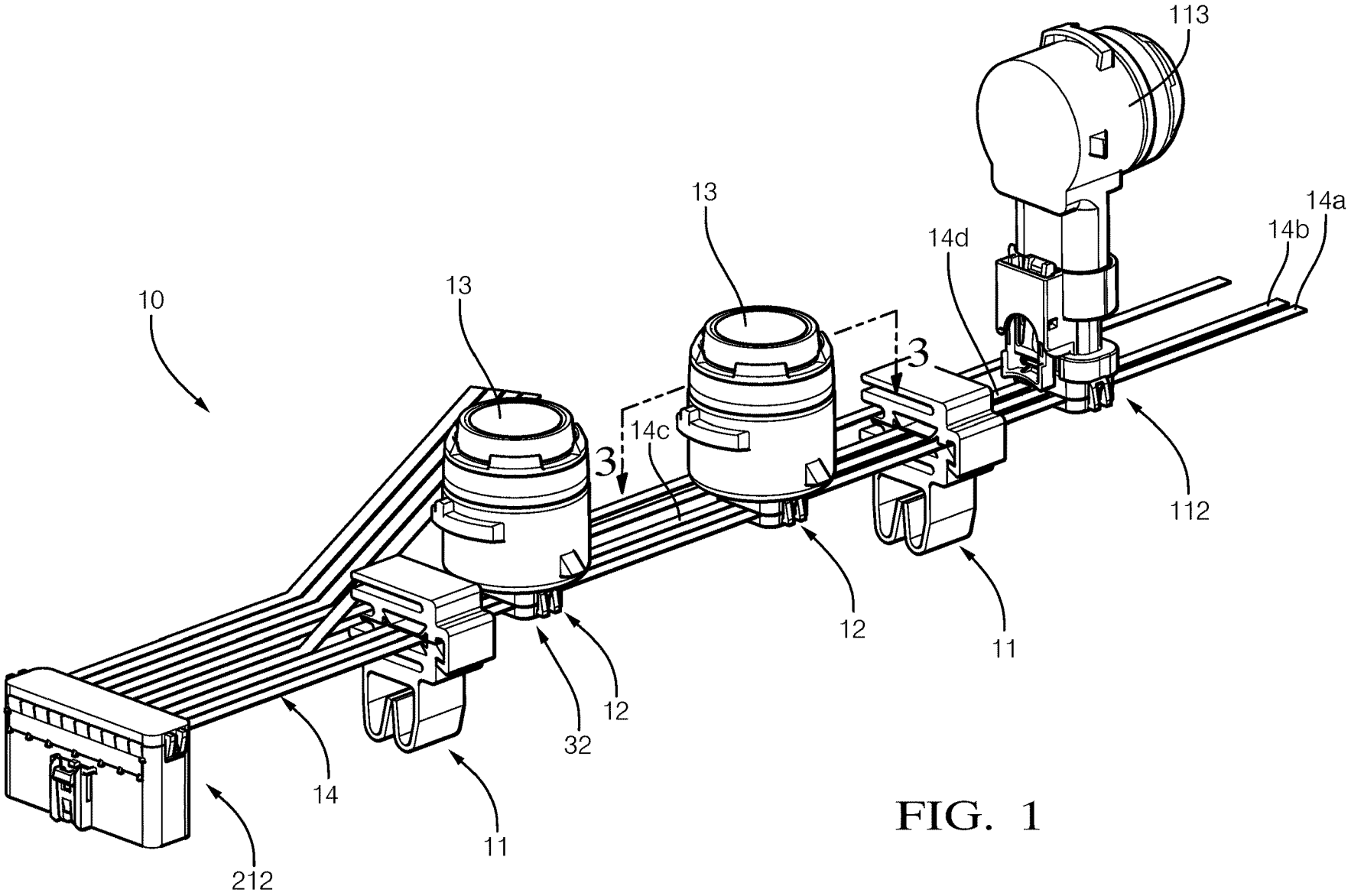
FIG. 1 is a schematic depiction of a wiring harness with multiple electrical connectors.

In the examples, the second housing portion 22 (FIGS. 2 and 3) includes electrical contacts provided by spring features 40 that supply electrical continuity between wiring 14 and the electrical component. Contact portions of the spring features have an arcuate shape. The connector is used in conjunction with wiring 14, which may include one or more wires 14*a*, 14*b*, 14*c*, etc. (FIG. 1). As best shown in FIG. 2, each wire includes a relatively flat conductor 16 that is generally rectangular and is encased in a non-conductive, flexible plastic insulation 18 to provide a cross-sectional aspect ratio of at least 2:1 with respect to the width and the height. As used herein, "generally rectangular" includes any shape having a width greater than its height in cross section and may include rectangular, parallelogram, trapezoid, oval, obround, and elliptical shapes. In some embodiments, the aspect ratio may be at least 3:1. In other embodiments, the aspect ratio may be at least 5:1. The conductor 16 is provided by non-stranded electrically conductive material, such as a flat copper wire plated with tin. The adjacent wires may be interconnected with insulation material that forms webbing 17, which provides structurally integrity to the wiring 14 during handling.

Figure 3:
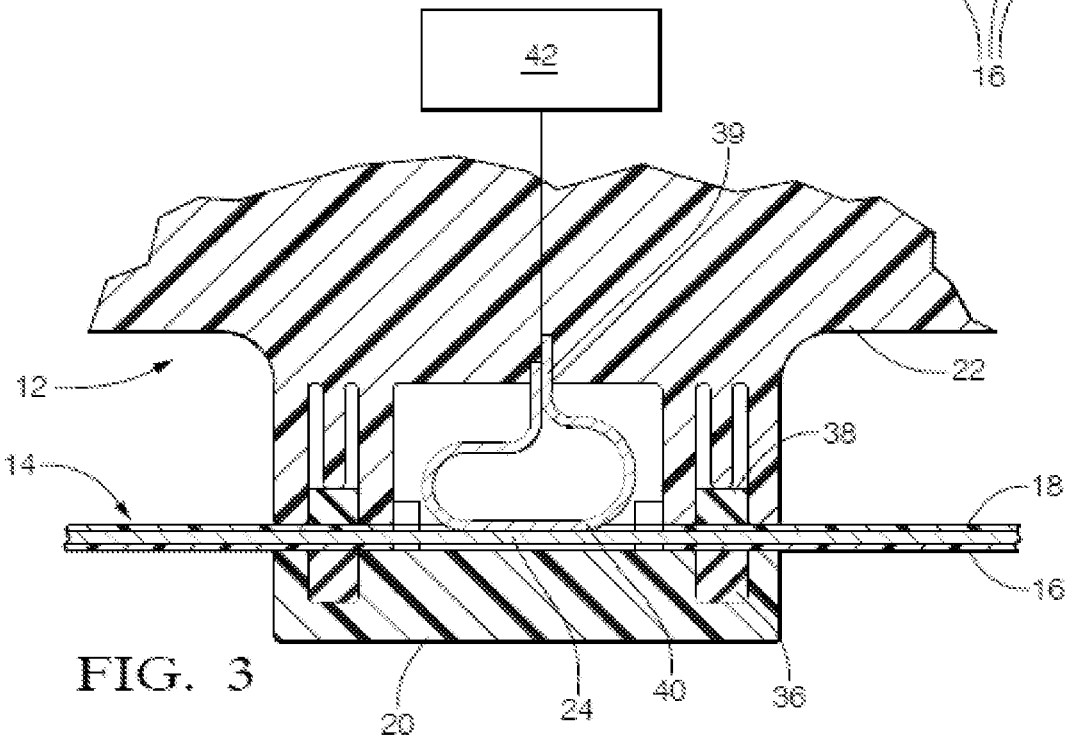
FIG. 3 is a partial cross-sectional view through the electrical connector shown in FIGS. 1 and 2 and taken along line 3-3 in FIG. 1.
Figure 4:
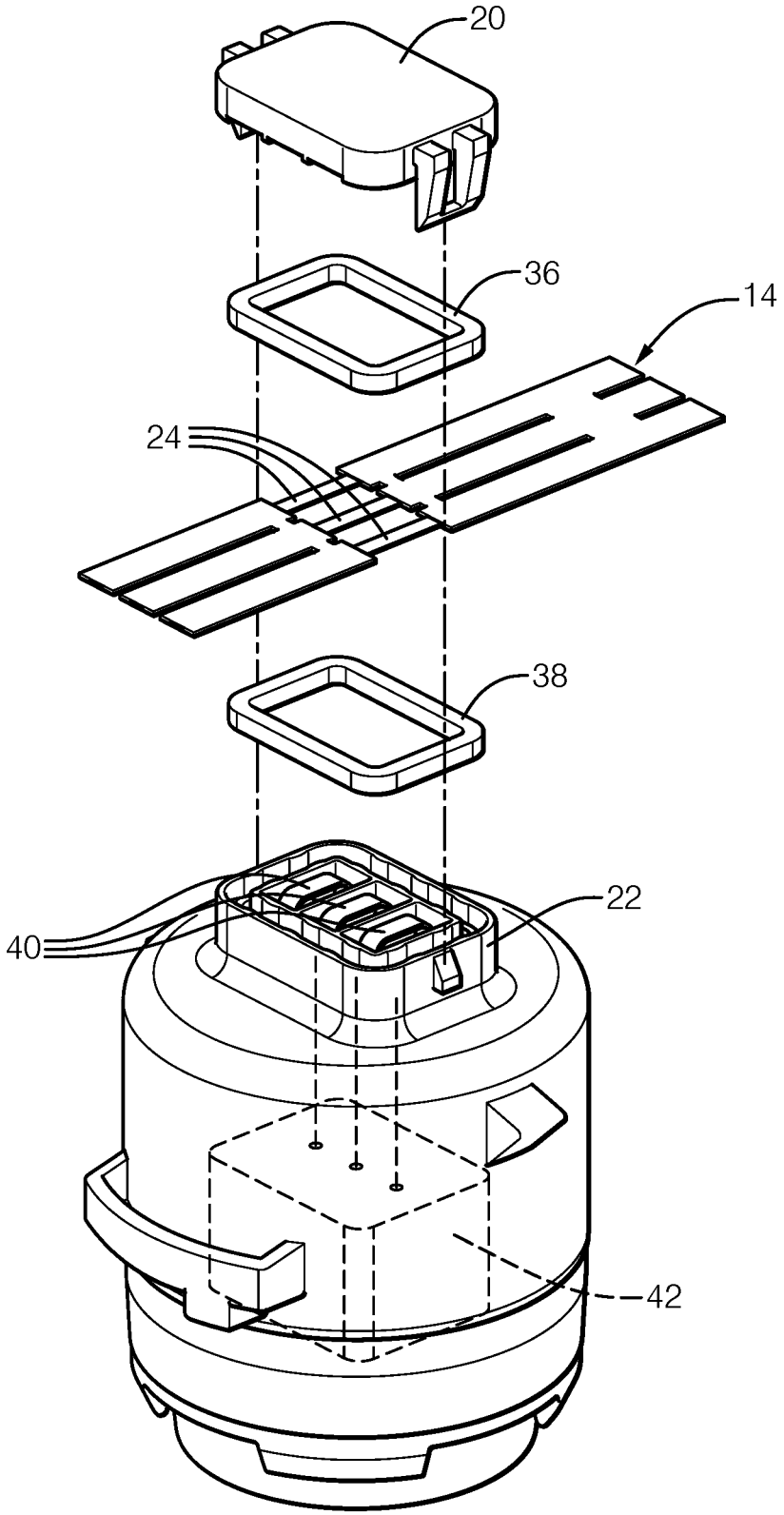
FIG. 4 is an exploded view of the electrical connector shown in FIGS. 1-3.

One example electrical connector shown in FIG. 1 is illustrated in more detail in FIGS. 2-4. It is desirable to positively locate the wiring 14 with respect to the housing 12 and to provide strain relief to the wires 14*a*, 14*b*, 14*c*. To this end, various locating features may be used between the housing 12 and wiring 14 to orient and securely hold the wiring 14 during assembly and use. The wires 14*a*, 14*b*, 14*c* have a stripped portion 24 that expose the conductors 16 at a longitudinal location defined by edges 26 of the insulation 18. That is, the stripped portions 24 are bounded by insulation 18 at either end, as best shown in FIG. 2. In the example, the first housing portion 20 includes a first set of barbs 28 spaced apart from a second set of barbs 30. The conductors 16 are clipped in beneath and retained by their respective sets of barbs. The first and second sets of barbs 28, 30 retain the stripped portions 24 longitudinally as well, such that the edges 26 are longitudinally located by the barbs to orient the wiring 14 in the desired position relative to the housing 12. In this illustrated embodiment, the barbs 28, 30 overlay the stripped portions 24. In this manner, the edges 26 and barbs 28, 30 cooperate to provide locating features that interact with one another to secure the wiring 14 relative to housing 12.

Referring to FIGS. 3 and 4, first and second seals 36, 38 are respectively supported by the first and second housing portions 20, 22 and arranged on opposing sides of the wiring 14 to provide a weatherproof connector.

For connectors needing to supply at least a power and ground connection, for example, the second housing portion 22 includes at least first and second springs (collectively, "40") respectively configured to engage the stripped portions 24 of at least first and second wires 14*a*, 14*b* when the first and second housing portions 20, 22 are secured to another in the assembled connector condition. Each spring feature 40 has a curved portion that engages its corresponding stripped portion 24. The curved portion extends to a longitudinally extending electrical connection portion 39 supported within the second housing portion 22, shown in FIG. 3. Each electrical connection portion 39 is arranged perpendicular to its corresponding stripped portion 24. This configuration enables the electrical connector to be place at a location other than terminal ends of wires, which typically requires more numerous wires and a more complex wiring harness.

In the example shown in FIGS. 2-4, the second housing 42 contains and encloses a sensor. The illustrated example shows an ultrasonic distance sensor, but the sensor may alternatively be a temperature sensor, pressure sensor, voltage sensor, current sensor, camera, radar sensor, or other electronic sensor. In this manner, the sensor is integrated into the electrical connector and forms part of its housing 12.

Figure 5:
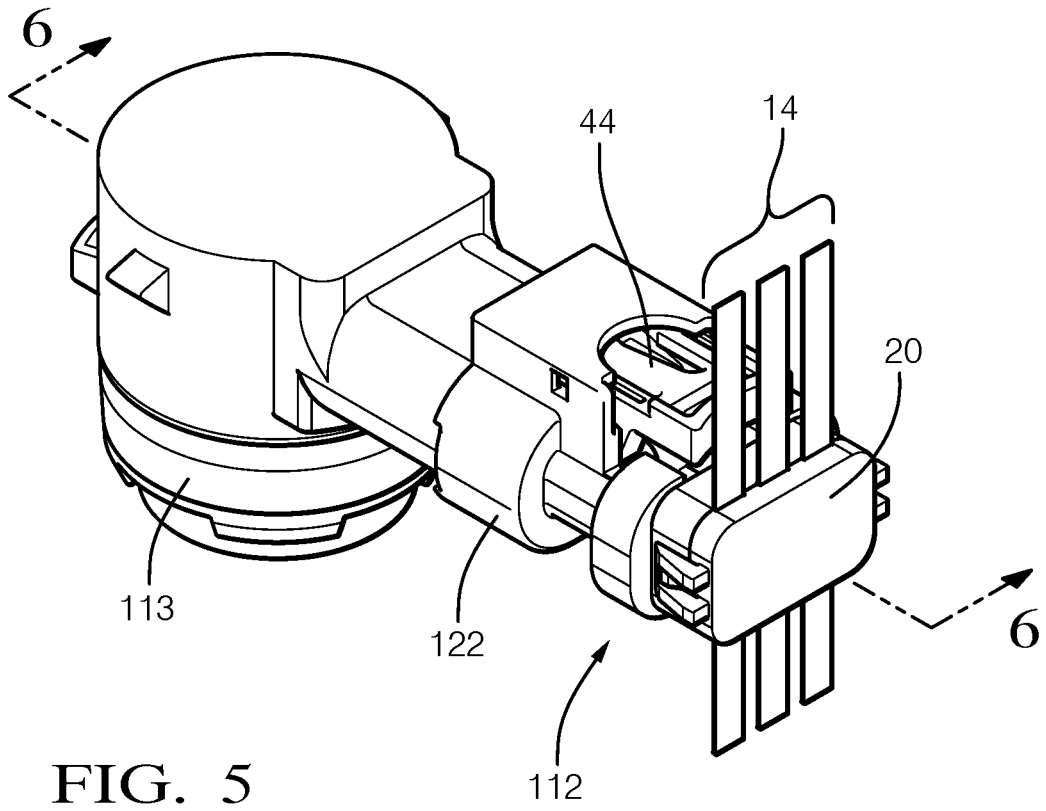
FIG. 5 is a perspective view of another electrical connector shown in FIG. 1.
Figure 6:
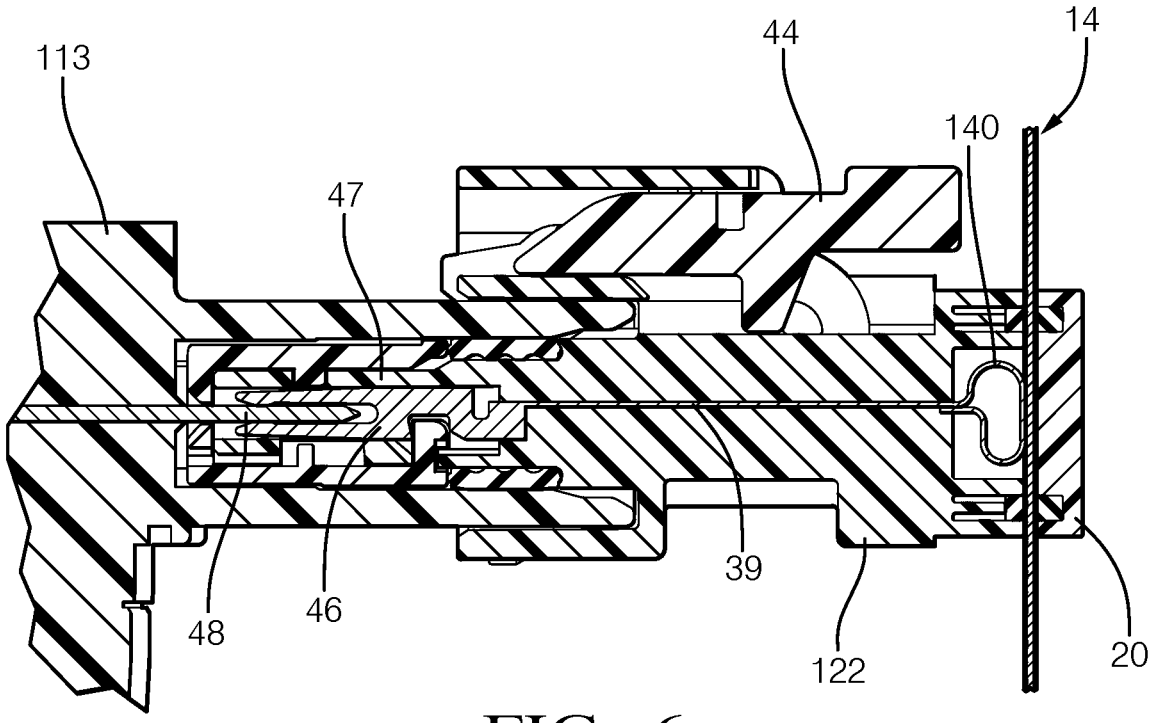
FIG. 6 is a cross-sectional view of the electrical connector shown in FIG. 5 taken along line 6-6.

Another electrical connector is shown in FIGS. 5-6. The electrical connector is provided by a housing 112 that is adapted for use with external electrical components, such as a sensor, that use legacy electrical connector configurations. The first housing portion 20 and wiring 14 may be configured as discussed in connection with FIGS. 2-4. In the example, the electrical connection portions 39 comprise spring features 140 that electrically contact wiring 14 and the electrical connection portions 39 terminate in male terminals and/or female terminals. The second housing portion 122 has an end 47 supporting the electrical connection portions 39 and female terminals 46 in the example. The electrical connection portions 39 and the associated terminal ends (i.e., female terminals 46) are exposed at the end 47 for removable electrical connection to an external electrical component 113. A secondary lock 44 is provided between the second housing portion 122 and the external electrical component 113. The secondary lock 44 is configured to selectively removably secure the second housing portion 122 and the external electrical component 113 to one another in a known manner.

Figure 7A:
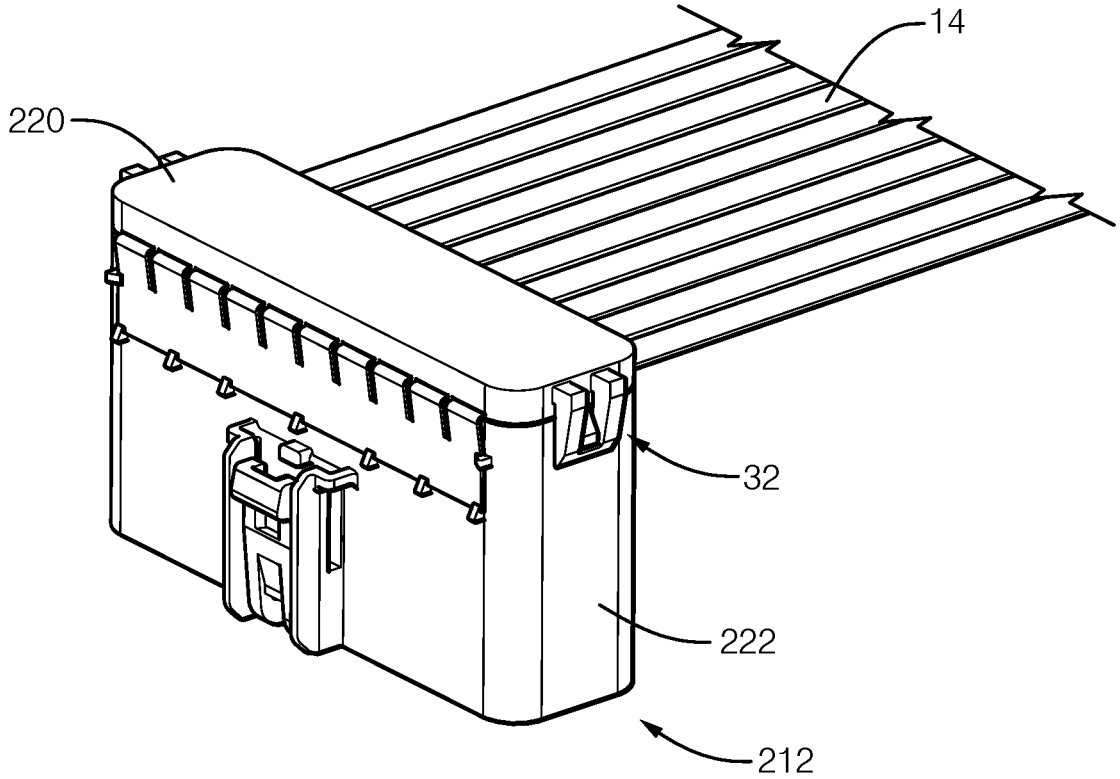
FIGS. 7A and 7B are first and second perspective views of yet another electrical connector shown in FIG. 1.
Figure 7B:
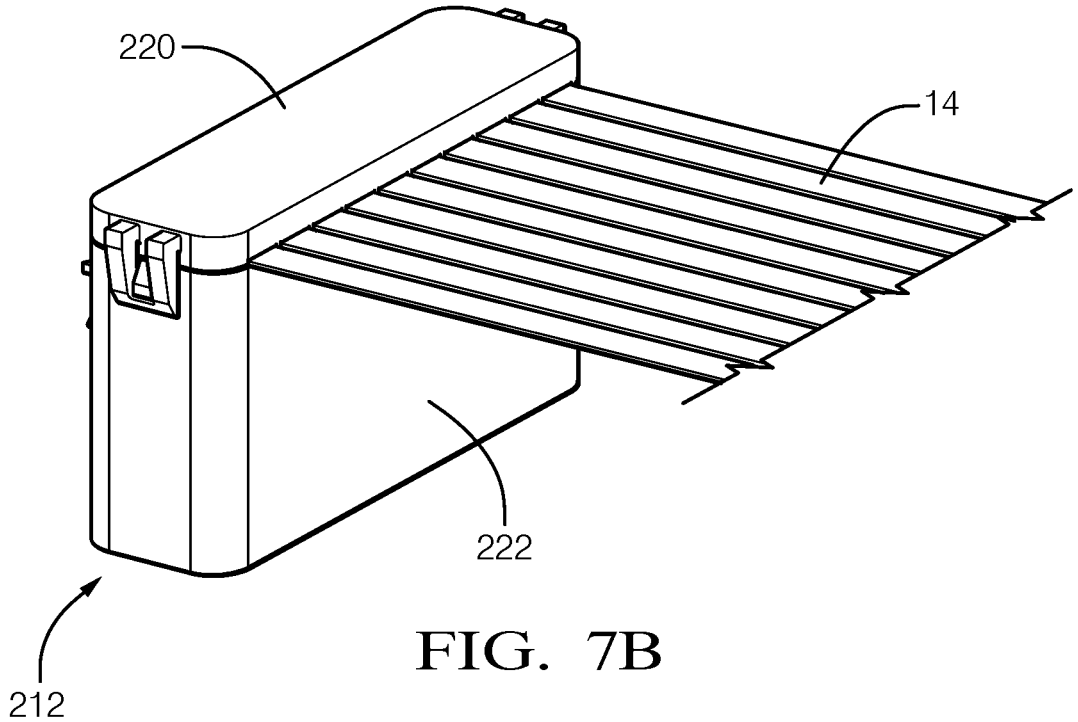
Figure 8:
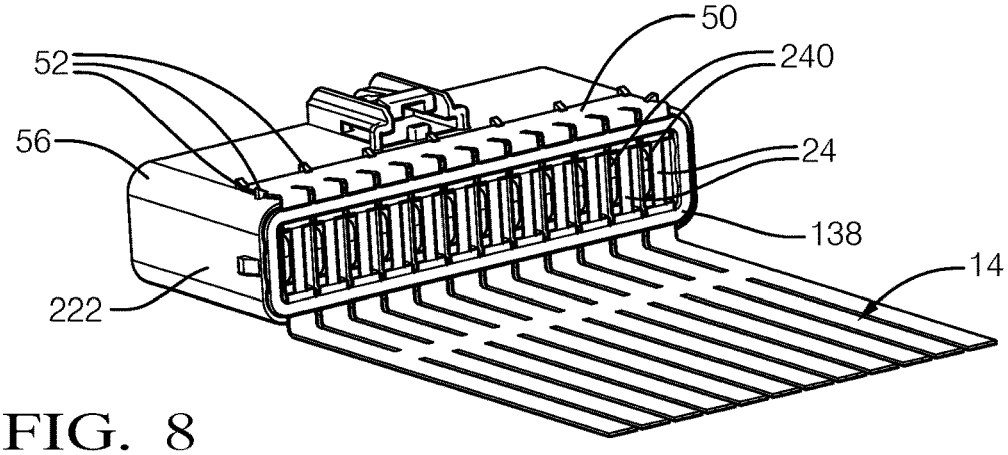
FIG. 8 is a perspective view of the electrical connector shown in FIGS. 7A and 7B, but with the first housing portion removed.

FIGS. 7A-9B illustrate an electrical connector that is at a termination of the wiring harness 10. The connector has a housing 212 that includes first and second housing portions 220, 222 secured to one another by snap features 32 to retain the wiring 14, as shown in FIGS. 7A-7B. Referring to FIG. 8, the wiring 14 includes a terminal end 50 that is supported on the second housing portion 222 by tabs 52 on a side 56 of the second housing. The terminal end 50 is covered in insulation 18. In this manner, uninsulated, free ends of the conductors 16 do not terminate within the housing 212. Springs 240 engage the stripped portions 24 in a similar manner to the electrical connectors previously discussed. One or more seals 138 may be used to seal about the wiring 14.

Figure 9A:
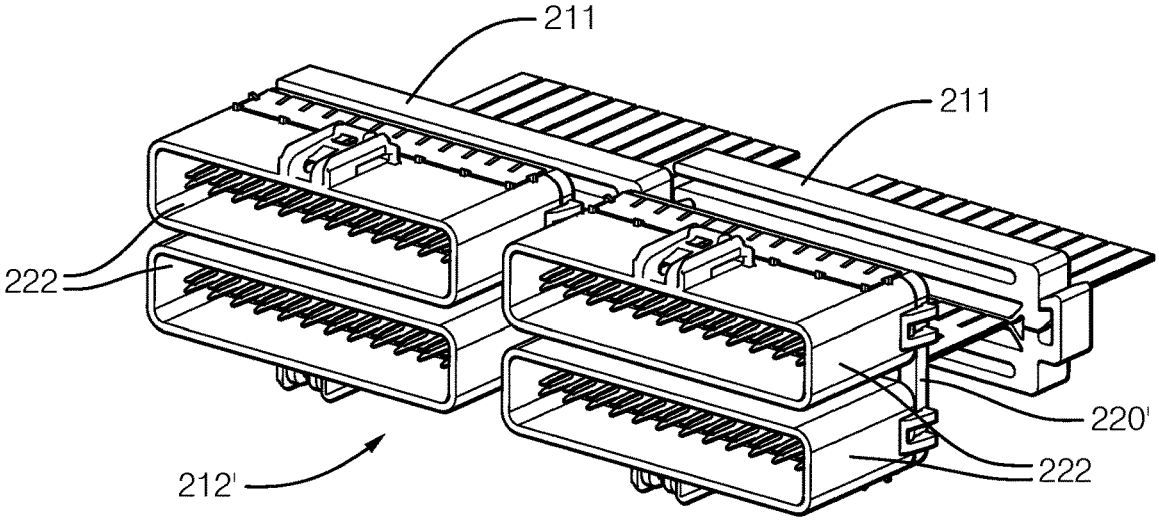
FIGS. 9A and 9B are first and second perspective views of multiple second housings as shown in FIGS. 7A-8, but with a common first housing.
Figure 9B:
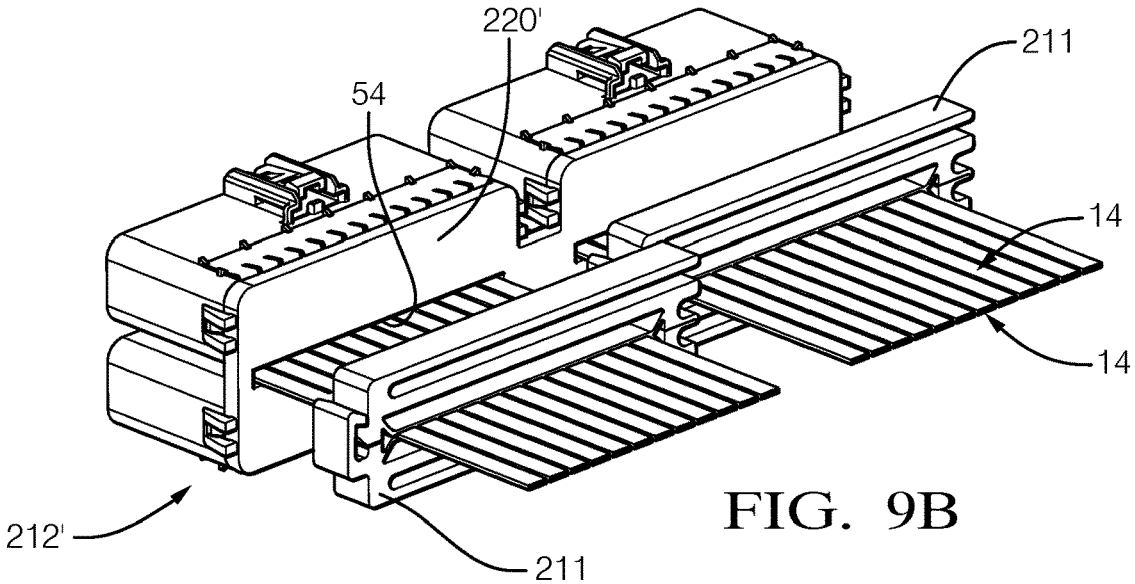

If multiple electrical connectors are secured to a common control module, it may be desirable to join the electrical connectors of the wiring harness to one another for easier handling. Referring to FIGS. 9A-9B, a first housing portion 220' is common to and secured to multiple second housing portions 222 to create a block of electrical connectors 212'. Although a block of four connectors is shown, fewer or more connectors may be joined to one another with a common first housing portion 220'. The first housing portion 220' includes a slot 54 that receives multiple bundles of wiring 14. The wirings 14 can be secured to one another by a clip 211 arranged near the first housing portion 220'.

Figure 10:
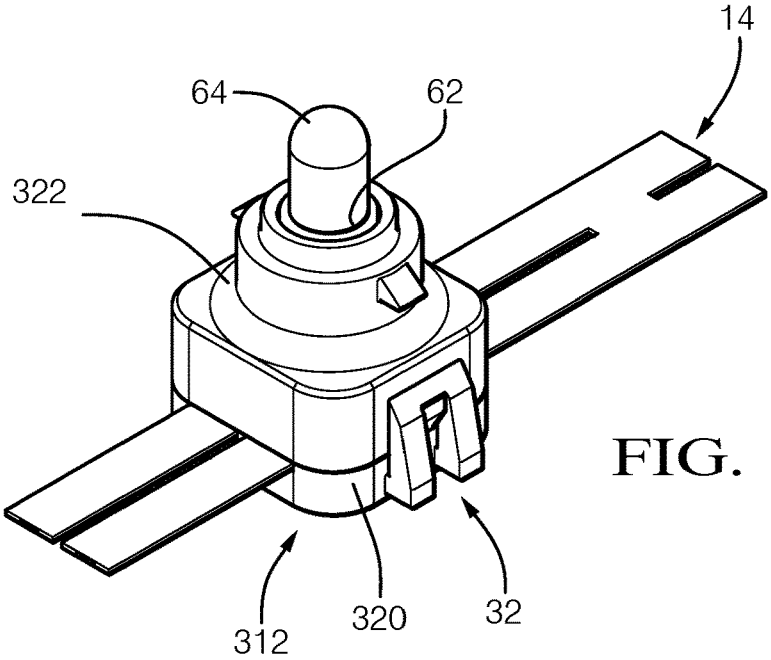
FIG. 10 is another electrical connector for use with a lighting device.
Figure 11:
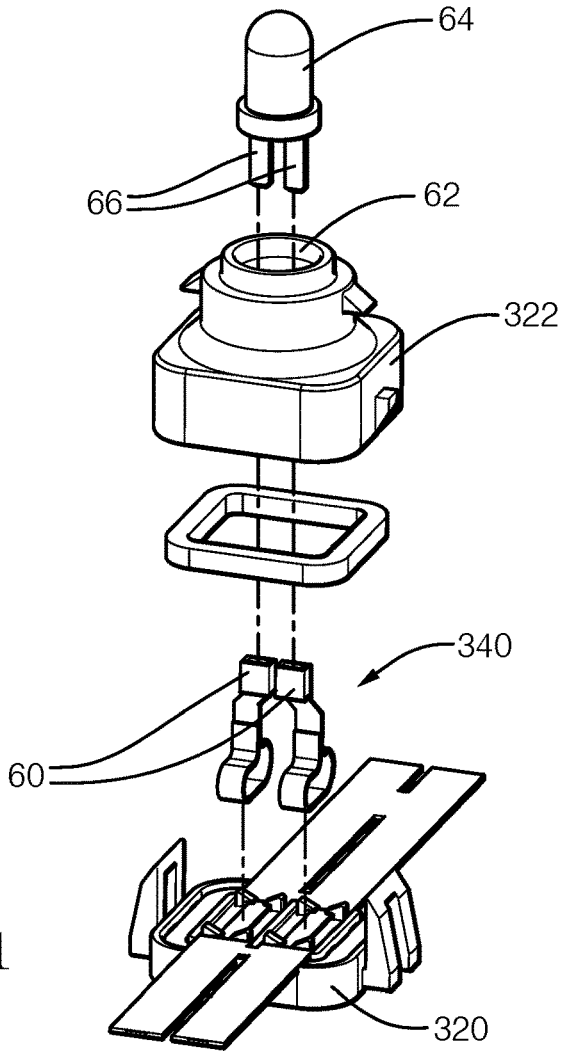
FIG. 11 is an exploded view of the electrical connector shown in FIG. 10.

Referring to FIGS. 10 and 11, the housing 312 may be used for lighting. The first housing portion 320 supports wiring 14 having two wires. The second housing portion 322 is joined to the first housing portion 320 by snap features 32 and includes a socket 62 that receives a lighting device 64, e.g. a light emitting diode (LED), an incandescent light bulb, an electroluminescent device, or an array or combination of these. In the example, the lighting device 64 includes male terminals 66 that are received in female terminals 60 joined to the springs 340.

Additional examples are provided below.

Example 1. An electrical connector comprising wiring (14) with first and second wires (14*a*, 14*b*), each of the first and second wires (14*a*, 14*b*) having a conductor (16) covered in insulation (18), the insulation (18) includes webbing (17) that interconnects the first and second wires (14*a*, 14*b*) to one another, the first and second wires (14*a*, 14*b*) having a stripped portion (24) exposing the conductors (16) and a housing (12) having first and second housing portions (20, 22), the first housing portion (20) receiving the stripped portions (24), and the second housing portion (22) includes first and second spring features (40) respectively configured to engage the stripped portions (24) of the first and second wires (14*a*, 14*b*) when the first and second housing portions (20, 22) are secured to another in an assembled connector condition.

Example 2. The electrical connector of example 1, wherein each spring feature (40) has a curved portion that engages its corresponding stripped portion (24), each curved portion extends to a longitudinally extending electrical connection portion (39) supported within the second housing portion (22), each electrical connection portion (39) arranged perpendicular to its corresponding stripped portion (24).

Example 3. The electrical connector of example 1 or 2, wherein the housing (12) includes at least one snap feature (32) removably connecting the first and second housing portions (20, 22) in the assembled connector condition.

Example 4. The electrical connector of any one of the preceding examples, wherein the electrical connection portions (39) terminate in a male terminal or a female terminal.

Example 5. The electrical connector of any one of the preceding examples, comprising first and second seals (36, 38) respectively supported by the first and second housing portions (20, 22) and arranged on opposing sides of the wiring (14).

Example 6. The electrical connector of any one of the preceding examples, wherein the second housing portion (22) has an end (47) supporting the electrical connection portions (39), the electrical connection portions (39) are exposed at the end (47) and configured for electrical connection to an external electrical component (113).

Example 7. The electrical connector of any one of the preceding examples, wherein the external electrical component (113) is a sensor.

Example 8. The electrical connector of any one of the preceding examples, comprising a secondary lock (44) provided between the second housing portion (22) and the external electrical component (113), the secondary lock (44) configured to selectively removably secure the second housing portion (22) and the external electrical component (113) to one another.

Example 9. The electrical connector of any one of the preceding examples, wherein the second housing portion (22) includes a socket (62), and the external electrical component (113) is a lighting device (64) received in the socket (62).

Example 10. The electrical connector of example 9, wherein the lighting device (64) includes male terminals (66), and the electrical connection portions (39) are female terminals (60) that are configured to receive the male terminals (66).

Example 11. The electrical connector of any one of the preceding examples, wherein the wiring (14) terminates at the second housing portion (22).

Example 12. The electrical connector of any one of the preceding examples, wherein the wiring (14) includes a terminal end (50) that is supported on the second housing portion (22).

Example 13. The electrical connector of any one of the preceding examples, wherein the terminal end (50) is mounted to an outside of the second housing portion (22).

Example 14. The electrical connector of any one of the preceding examples, wherein the first housing portion (220) is common to and secured to a multiple of the second housing portion (222), wherein the wiring (14) is a first wiring connected between the first housing portion (220) and one of the multiple of second housing portions (222), and comprising a second wiring connected between the first housing portion (220) and another of the multiple of second housing portions (222), the second wiring (14) having third and fourth wires (14*a*, 14*b*), each of the third and fourth wires (14*a*, 14*b*) having second conductors (16) covered in a second insulation (18), the second insulation (18) includes a second webbing (17) that interconnects the third and fourth wires (14*a*, 14*b*) to one another, the third and fourth wires (14*a*, 14*b*) having second stripped portions (24) exposing the second conductors (16), the first housing portion (220) receiving the second stripped portions (24), and the second housing portion (222) includes third and fourth spring features (40) respectively configured to engage the second stripped portions (24) of the third and fourth wires (14*a*, 14*b*) when the first housing portion (220) and the second of the multiple of second housing portions (220, 222) are secured to another in the assembled connector condition, wherein the first housing portion (220) includes a slot (54) configured to receive the first wiring and the second wiring (14).

Example 15. The electrical connector of any one of the preceding examples, wherein the second housing (222) contains a sensor electrically connected to the first and second spring features (340).

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. An electrical connector comprising:

wiring with first and second wires, each of the first and second wires having a conductor covered in insulation, the insulation includes webbing that interconnects the first and second wires to one another, the first and second wires having a stripped portion exposing the conductors; and a housing having first and second housing portions, the first housing portion receiving the stripped portions, and the second housing portion includes first and second spring features respectively configured to engage the stripped portions of the first and second wires when the first and second housing portions are secured to another in an assembled connector condition, wherein the first housing portion is common to and secured to a multiple of the second housing portion, wherein the wiring is a first wiring connected between the first housing portion and one of the multiple of second housing portions, and comprising a second wiring connected between the first housing portion and another of the multiple of second housing portions, the second wiring having third and fourth wires, each of the third and fourth wires having second conductors covered in a second insulation, the second insulation includes a second webbing that interconnects the third and fourth wires to one another, the third and fourth wires having second stripped portions exposing the second conductors, the first housing portion receiving the second stripped portions, and the second housing portion includes third and fourth spring features respectively configured to engage the second stripped portions of the third and fourth wires when the first housing portion and the second of the multiple of second housing portions are secured to another in the assembled connector condition.

2. The electrical connector of claim 1, wherein each spring feature has a curved portion that engages its corresponding stripped portion, each curved portion extends to a longitudinally extending electrical connection portion supported within the second housing portion, each electrical connection portion arranged perpendicular to its corresponding stripped portion.

3. The electrical connector of claim 1, wherein the housing includes at least one snap feature removably connecting the first and second housing portions in the assembled connector condition.

4. The electrical connector of claim 1, wherein the electrical connection portions terminate in a male terminal or a female terminal.

5. The electrical connector of claim 1, comprising first and second seals respectively supported by the first and second housing portions and arranged on opposing sides of the wiring.

6. The electrical connector of claim 1, wherein the second housing portion has an end supporting the electrical connection portions, the electrical connection portions are exposed at the end and configured for electrical connection to an external electrical component.

7. The electrical connector of claim 1, wherein the external electrical component is a sensor.

8. The electrical connector of claim 1, comprising a secondary lock provided between the second housing portion and the external electrical component, the secondary lock configured to selectively removably secure the second housing portion and the external electrical component to one another.

9. The electrical connector of claim 1, wherein the second housing portion includes a socket, and the external electrical component is a lighting device received in the socket.

10. The electrical connector of claim 9, wherein the lighting device includes male terminals, and the electrical connection portions are female terminals that are configured to receive the male terminals.

11. The electrical connector of claim 1, wherein the wiring terminates at the second housing portion.

12. The electrical connector of claim 1, wherein the wiring includes a terminal end that is supported on the second housing portion.

13. The electrical connector of claim 12, wherein the terminal end is mounted to an outside of the second housing portion.

14. The electrical connector of claim 1, wherein the first housing portion includes a slot configured to receive the first wiring and the second wiring.

15. A wiring harness comprising the electrical connector of claim 14, further comprising a clip configured to secure the first wiring and the second wiring near the first housing portion.

16. The electrical connector of claim 1, wherein the second housing contains a sensor electrically connected to the first and second spring features.

17. A wiring harness comprising the electrical connector of claim 1.

18. The wiring harness of claim 17, comprising a multiple of the electrical connectors of claim 1.

19. A wiring harness comprising:

an electrical connector comprising:

wiring with first and second wires, each of the first and second wires having a conductor covered in insulation, the insulation includes webbing that interconnects the first and second wires to one another, the first and second wires having a stripped portion exposing the conductors; and a housing having first and second housing portions, the first housing portion receiving the stripped portions, and the second housing portion includes first and second spring features respectively configured to engage the stripped portions of the first and second wires when the first and second housing portions are secured to another in an assembled connector condition, wherein the first housing portion is common to and secured to a multiple of the second housing portion, wherein the wiring is a first wiring connected between the first housing portion and one of the multiple of second housing portions, and comprising a second wiring connected between the first housing portion and another of the multiple of second housing portions, the second wiring having third and fourth wires, each of the third and fourth wires having second conductors covered in a second insulation, the second insulation includes a second webbing that interconnects the third and fourth wires to one another, the third and fourth wires having second stripped portions exposing the second conductors, the first housing portion receiving the second stripped portions, and the second housing portion includes third and fourth spring features respectively configured to engage the second stripped portions of the third and fourth wires when the first housing portion and the second of the multiple of second housing portions are secured to another in the assembled connector condition, and wherein the first housing portion includes a slot configured to receive the first wiring and the second wiring; and a clip configured to secure the first wiring and the second wiring near the first housing portion.

* * * * *